US007503241B2

(12) United States Patent
Dassaud et al.

(10) Patent No.: US 7,503,241 B2
(45) Date of Patent: Mar. 17, 2009

(54) DEVICE FOR SHARPENING THE BLADE OF A MANUAL CUTTING TOOL

(75) Inventors: Nathalie Dassaud, Thiers (FR); René Dassaud, Thiers (FR)

(73) Assignee: Dassaud Fils, Courpiere (FR)

( * ) Notice: Subject to any disclaimer, the term of this patent is extended or adjusted under 35 U.S.C. 154(b) by 0 days.

(21) Appl. No.: 10/590,361

(22) PCT Filed: Mar. 3, 2005

(86) PCT No.: PCT/FR2005/000502

§ 371 (c)(1),
(2), (4) Date: May 16, 2007

(87) PCT Pub. No.: WO2005/087437

PCT Pub. Date: Sep. 22, 2005

(65) Prior Publication Data

US 2008/0041190 A1 Feb. 21, 2008

(30) Foreign Application Priority Data

Mar. 4, 2004 (FR) ..... 04 02272

(51) Int. Cl.
*B24B 3/54* (2006.01)
*B24D 15/08* (2006.01)

(52) U.S. Cl. ..... 76/86; 76/88; 451/486; 451/553; 451/555

(58) Field of Classification Search ..... 76/82, 76/86, 88; 451/521, 523, 540, 555, 556, 451/557, 558
See application file for complete search history.

(56) References Cited

U.S. PATENT DOCUMENTS

| | | | | | |
|---|---|---|---|---|---|
| 4,494,340 | A * | 1/1985 | Carter | 451/555 |
| 4,751,795 | A * | 6/1988 | Jenne | 451/558 |
| 4,934,110 | A * | 6/1990 | Juranitch | 451/486 |
| 5,040,435 | A * | 8/1991 | Millman | 76/86 |
| 5,440,953 | A * | 8/1995 | Gangelhoff et al. | 76/86 |
| 5,478,272 | A | 12/1995 | Cozzini | |
| 5,505,107 | A * | 4/1996 | Frost | 76/86 |
| 5,655,959 | A | 8/1997 | Juranitch | |
| 6,866,569 | B2 * | 3/2005 | Cozzini | 451/349 |
| 2004/0014415 | A1 | 1/2004 | Stallegger et al. | |

* cited by examiner

*Primary Examiner*—Hwei-Siu C Payer
(74) *Attorney, Agent, or Firm*—Dowell & Dowell, P.C.

(57) ABSTRACT

The invention relates to a device (1) for sharpening the blade of a manual cutting tool, in particular a knife. The inventive device comprises a support (2) provided with a cutout (4). Identical sharpening levers are arranged on each side of the cutout in front and in staggering manner with respect to each other and provided with a curved arm (13) having a rectilinear end edge (14) and another arm (16) forming means for returning in a position by gravity. Each lever (11) is pivotally mounted in the jointing area (15) of the arms (13, 16) around an geometrical axis which is generally perpendicular to a longitudinal direction (A-A') of the cutout and a slot (5). Said device is particularly adapter to the agriculture and food industry.

11 Claims, 6 Drawing Sheets

DEVICE FOR SHARPENING THE BLADE OF A MANUAL CUTTING TOOL

BACKGROUND OF THE INVENTION

1. Field of the Invention

The invention relates to a device for sharpening a blade of a manual cutting tool, in particular a knife, comprising a support which is provided with a cut-out, sharpening elements being placed opposite each other and in a staggered arrangement in the region of the cut-out, being mounted so as to rotate about shafts which are fixed to the support and being provided with means for returning into position so as to define a sharpening zone which is variable in accordance with the position of the blade of a tool between the sharpening elements.

2. Brief Description of the Related Art

Devices of this type are used in the food-processing industry and in particular in the meat industry in order to reshape the edge of the knives used in a simple and rapid manner. Taking into account the speeds of production lines and the harsh environment encountered in these industries, owing, for example, to the ambient humidity and grease, it is necessary to have sharpening devices which are easy to use, clean and maintain and which are robust.

U.S. Pat. No. B 5,655,959 discloses a sharpening device which comprises a plate which supports two shafts on which curved shanks are mounted so as to freely rotate. These shanks are arranged at the sides of a cut-out, in this instance, two at one side and the third at the other side, so as to intersect with each other. They are provided at one end with an ancillary component which forms a counterweight. Cams which are located below the shanks in the region of the counterweights allow the return force to be adapted. It should be noted that one of the counterweights has a different mass from those of the other two counterweights. In this instance, the rod which carries this counterweight acts as a blade guide. Rods are arranged so as to guide and form travel end stops for the shanks. The zone which is located between the shanks which intersect forms a sharpening region. The knife is guided in this region by the formation of an aperture which is arranged in the support.

With a device of this type, the sharpening is carried out by only two shanks, those which have identical counterweights. Furthermore, controlling the cams in an identical manner is not simple, which often brings about a distortion of the sharpening zone, the force applied by each rod not being identical. Furthermore, guiding the blade as it is introduced into the notch of the support is not simple, the blade often coming into contact with the support which renders this blade increasingly blunt and brings about damage to the support. Finally, this device is relatively fragile.

These are the disadvantages which are intended to be overcome in particular by the invention by providing a sharpening device which is particularly simple to use and which has an effective sharpening zone.

SUMMARY OF THE INVENTION

To this end, the invention relates to a sharpening device of the above-mentioned type, characterised in that the sharpening elements comprise at least three identical levers, each lever being angled and provided with two arms, of which one is generally curved and provided with an end having a substantially rectilinear edge whilst the other arm constitutes a means for returning the lever into position by means of gravity, the lever being mounted so as to be able to pivot, in the region of a junction zone between the arms, about a geometric axis which is generally perpendicular relative to the longitudinal direction of the cut-out.

Using the invention, a sharpening device is thus produced wherein the sharpening zone is effective over the entire length of the path of the blade in the cut-out of the support, the whole having a simple and robust construction, the introduction of the blade being facilitated by the complementary shapes of the cut-out and a portion of the levers.

According to features of the invention which are advantageous but not obligatory, the sharpening device comprises one or more of the following features:

- each lever comprises an arm, one edge of which has a generally hemispherical cross-section and is suitable for being in contact with a blade of a tool;
- the edge of the arm of at least one lever is polished at least in the curved portion of the arm and is finely ribbed in the manner of a sharpening steel, at least in the region of the end of the same arm;
- the levers are suitable for being blocked in a position referred to as the rest position, in which the spacing between the ends is at a maximum, by means of two stops which are fixed to the support and which are produced from a material which attenuates impacts;
- the support is provided with a third stop which is generally located half-way between the two stops of attenuating material and which is suitable for blocking the levers in a position in which the spacing between the ends is at a minimum. Advantageously, the third stop has a length and a shape suitable for retaining at least one of the levers in a position referred to as the cleaning position in which it is not free in terms of rotation;
- the third stop is provided with a protection means, in particular a sleeve of flexible material;
- the levers are arranged so as to cover the periphery of the cut-out which is arranged in the support when the levers are in a rest position;
- each arm which forms a return means is provided with a means for fixing a supplementary gravity return means, in particular a weight;
- the levers are retained with spacing from the support and/or from each other by means of removable discs;
- the support is provided with a gripping means and/or fastening means.

BRIEF DESCRIPTION OF DRAWINGS

The invention will be better understood and other advantages thereof will be appreciated more clearly from the following description of two embodiments of a sharpening device according to the invention, given purely by way of example and with reference to the appended drawings, in which.

DESCRIPTION OF THE PREFERRED EMBODIMENT

Figure 1:
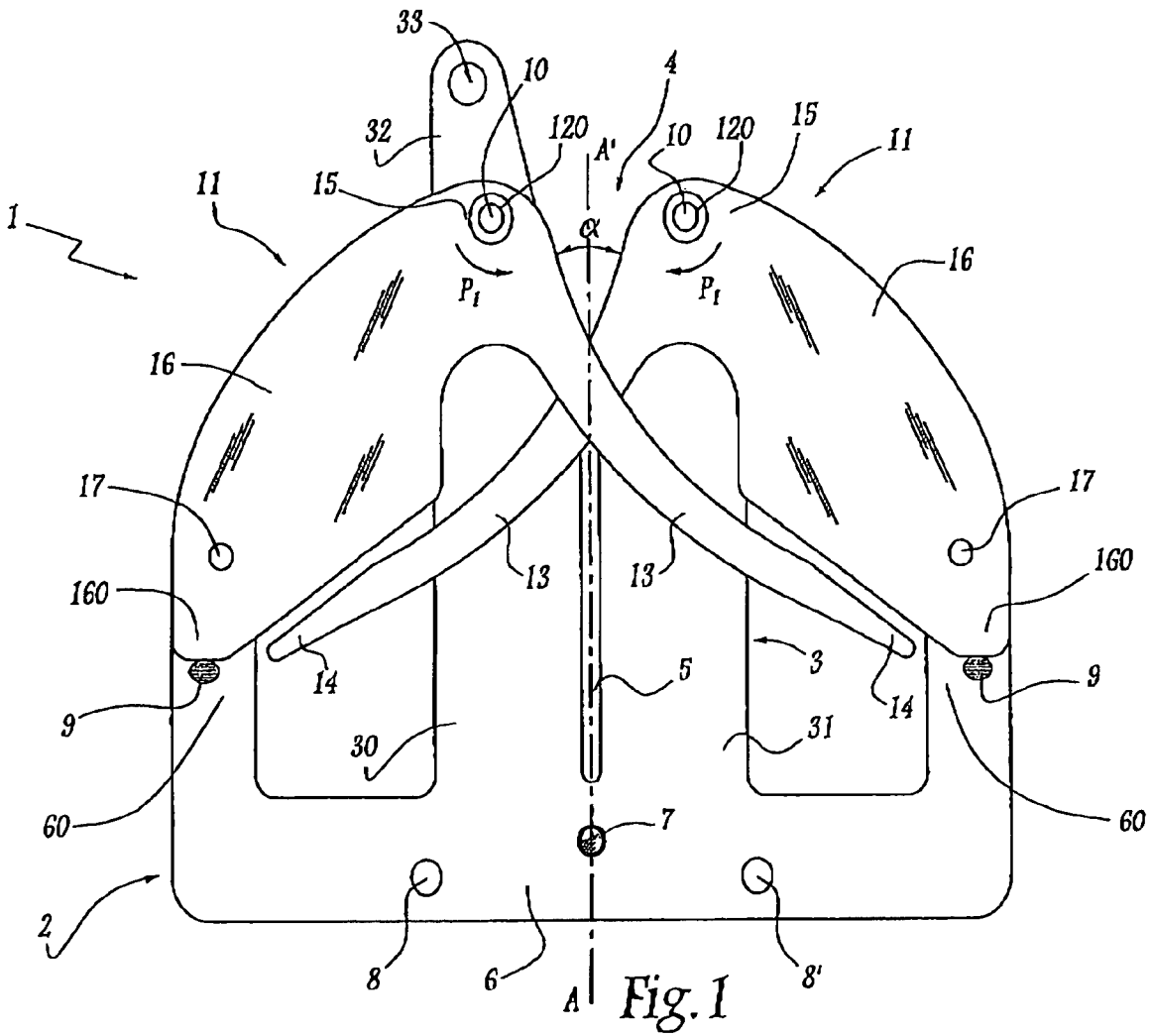
FIG. 1 is a front view of a sharpening device in accordance with a first embodiment of the invention, in a rest position.

The sharpening device 1 illustrated in FIG. 1 comprises a support 2 which is generally T-shaped, planar and thin. This support 2 is produced from an inflexible material which is resistant to the environment in which it is placed, in particular resistant to chemical attacks and corrosion, Advantageously, it is machined from a plate of stainless steel. The leg 3 of the T is directed upwards and has a cut-out 4 which extends from the free end thereof over approximately a third of the length thereof. This cut-out 4 is generally V-shaped and extends, via a rectilinear aperture 5, as far as the intersection with the transverse bar 6 of the T. This aperture 5 is directed in a direction which is generally parallel with a longitudinal axis A-A' of the leg 3 of the T. This leg 3 has a portion 30 which is located at one side of the aperture 5 and the cut-out 4. One end of this portion 30, which is longer than the portion 31 located at the other side of the aperture 5 and the cut-out 4, forms a gripping element 32. Advantageously, this gripping element 32 comprises a fastening element which is formed by a hole 33 which allows the device to be suspended, in particular during cleaning operations. In a device 1 which is not illustrated and which is suitable for use by left-handed persons, the gripping element is arranged at the end of the portion 31 of the leg 3 of the support.

A stop 7 which is formed by a stud or a shank which is produced from an inflexible material which is resistant to attacks, advantageously of stainless steel or brass, is positioned on the transverse bar 6 in the region of the closed end of the aperture 5. This stop or shank 7 extends from the bar 6 and is orientated in a main direction $D_7$ which is generally perpendicular relative to the axis A-A' and the plane of the support 2.

This stop 7 is surrounded by two holes 8 and 8' which are arranged in the support and which allow the support to be fixed, for example, to a workstation, by means of fixing elements which are not illustrated and which are known per se, in particular pins, rivets or screws.

The support 2 is also provided with two other stops 9 which are produced from a material which is resistant to the physical and chemical attacks present at the workstation and which attenuates impacts. Advantageously, these stops 9 are produced from rubber material, elastomer or polymer. These two stops 9, which are identical, which have an oval cross-section and dimensions which are substantially greater than those of the stop 7, are positioned at the ends 60 of the transverse bar 6 of the support 2.

The stops 9 are arranged at one side and the other of the stop 7 with equal spacing therefrom. The stops 9 extend from the bar 6 and are orientated in a main direction $D_9$ which is generally parallel with the direction $D_7$.

Three stops 7 and 9 are thus produced arranged in the form of a triangle.

At the free end of the leg 3 and in the region of the opening of the cut-out 4, two fixed and parallel shafts 10 are arranged at each side thereof. These shafts 10 extend from the portions 30, 31 of the leg 3 and are orientated in accordance with a geometric axis $D_{10}$ which is generally perpendicular relative to the axis A-A' and the plane of the support 2.

Sharpening levers 11 are mounted so as to freely rotate on these shafts 10. These levers 11, of which there are three, are identical and are arranged at each side of the cut-out 4 and the aperture 5, two at the side of the portion 31, one at the side of the portion 30. They are retained with spacing from the support 2 and from each other by means of removable rings or discs 12. Their blocking in terms of translation on each shaft 10 is brought about, in a removable manner, for example, by means of a screw/nut assembly 120. It is thus possible to easily modify the spacing between a lever 11 and the support 2 and/or between each lever 11 by adding or removing one or more discs 12. In the same manner, inserting additional levers 11 or changing a defective lever 11 is carried out in a simple manner. These levers 11 are in the form of a planar, unitary component which is thin and which is produced from an inflexible material, having a hardness which is greater than the hardness of the knife blades to be sharpened and which is resistant to physical and chemical attacks. Advantageously, the levers 11 are of martensitic stainless steel having a minimum hardness of approximately 57 HRC.

The levers 11 are angled and formed by two arms 13, 16.

The arm 13 is curved and configured so as to have a curvature which is adapted to the shape of the cut-out 4. The arm 13 terminates in an end 14, which constitutes approximately from 20 to 30% of the total length of the arm 13 and which is not curved inwards but instead has a rectilinear edge.

Each arm 13 has an edge F which generally has a semicircular cross-section. The edge F, which is rounded, is located at one side of the cut-out 4 and the aperture 5 facing an edge F of another arm 13 located at the other side of the cut-out 4 and the aperture 5.

The junction zone 15 between the arm 13 and the arm 16 of the same lever 11, that is, the "angled" zone of the lever 11, is provided with a hole which allows the lever 11 to be mounted freely in terms of rotation on a shaft 10.

This same zone 15 continues with an arm 16, which is integral with the zone 15 and the arm 13. This arm 16 extends outwards relative to the curvature of the arm 13. The arm 16 is generally of trapezoidal form. Each lever 11 thus generally has the shape of a hatchet whose handle is curved inwards.

The arm 16 is sufficiently large to form a counterweight when the lever 11 is mounted on its shaft of rotation 10, and thus move the inwardly curved arm 13 upwards by means of pivoting in the direction of the arrows $P_1$ in FIG. 1 in the absence of force applied by the user. At one end 160 of the counterweight 16, opposite the zone 15, the counterweight is provided with a hole 17 which optionally allows an additional weight to be fastened.

The levers 11 are arranged on the support 2, with two of the levers being pivoted at the same point on one side of the cut-out 4 so that their inwardly curved arms 13 are oriented opposite the inwardly curved arm of the other lever 11 which is pivoted to the support on the opposite side of the cut-out 4. The two levers 11 are thus located at the same side of the cut-out 4 and the aperture 5 in a superimposed manner, but with no mutual abutment owing to the side which keep them spaced apart. In this instance, they are located on the portion 31 of the leg 3.

The third lever 11 is located at the other side on the portion 30 of the leg 3. This third lever has the curved arm 13 and rectilinear end 14 thereof orientated in the direction of the other two levers 11 and arranged in the space located between these two levers 11. That is to say, the inwardly curved arms 13 of the levers 11 are placed in a staggered arrangement and intersect. The spacing between the various levers 11 is sufficient to prevent the arms 13, 16 from coming into contact during their respective movements.

In a rest position, illustrated in FIG. 1, the levers 11 generally form an X whose upper branches partially cover the edges of the cut-out 4 of the support. The levers are retained in this rest position by the end 160 of the arms or counterweights 16 being in abutment against the stops 9. In this rest position, the shape and the dimensions of the arms 13, in particular the ends 14 thereof, prevent any contact between the arms 13 and any contact between their ends 14 and the stops 9.

In this position, the arms 13 which cover the periphery of the cut-out 4 together form an angle α of approximately 60 degrees.

Figure 4:
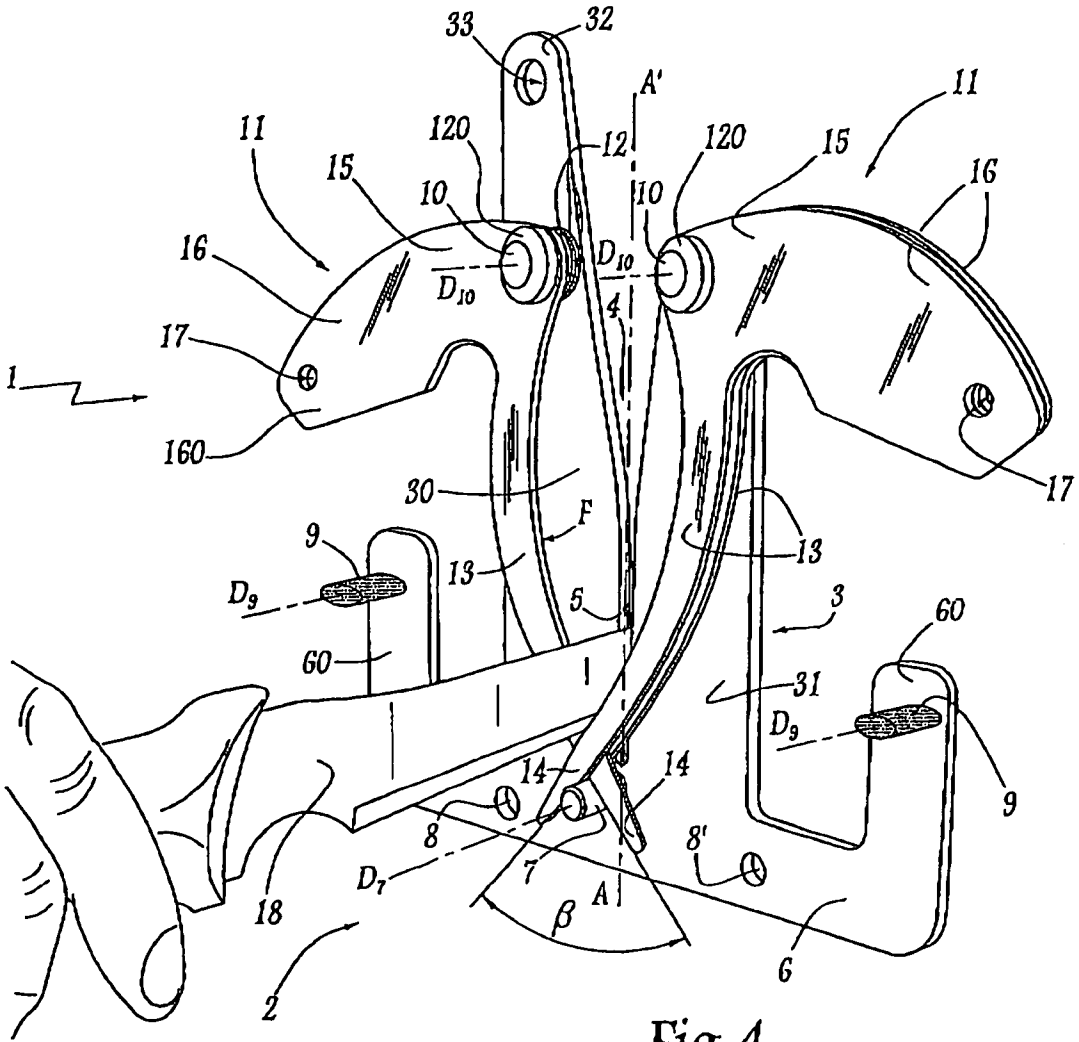

In the position of maximum spacing of the arms 13, illustrated in FIG. 4, the rectilinear ends 14 are in abutment against the central stop 7, the counterweights 16 not being in abutment against the stops 9. In this configuration, the peripheries of the cut-out 4 and the aperture 5 of the support are not generally covered by the arms 13. In this position, the ends 14 together form an angle β of approximately 45 degrees.

Figure 3:
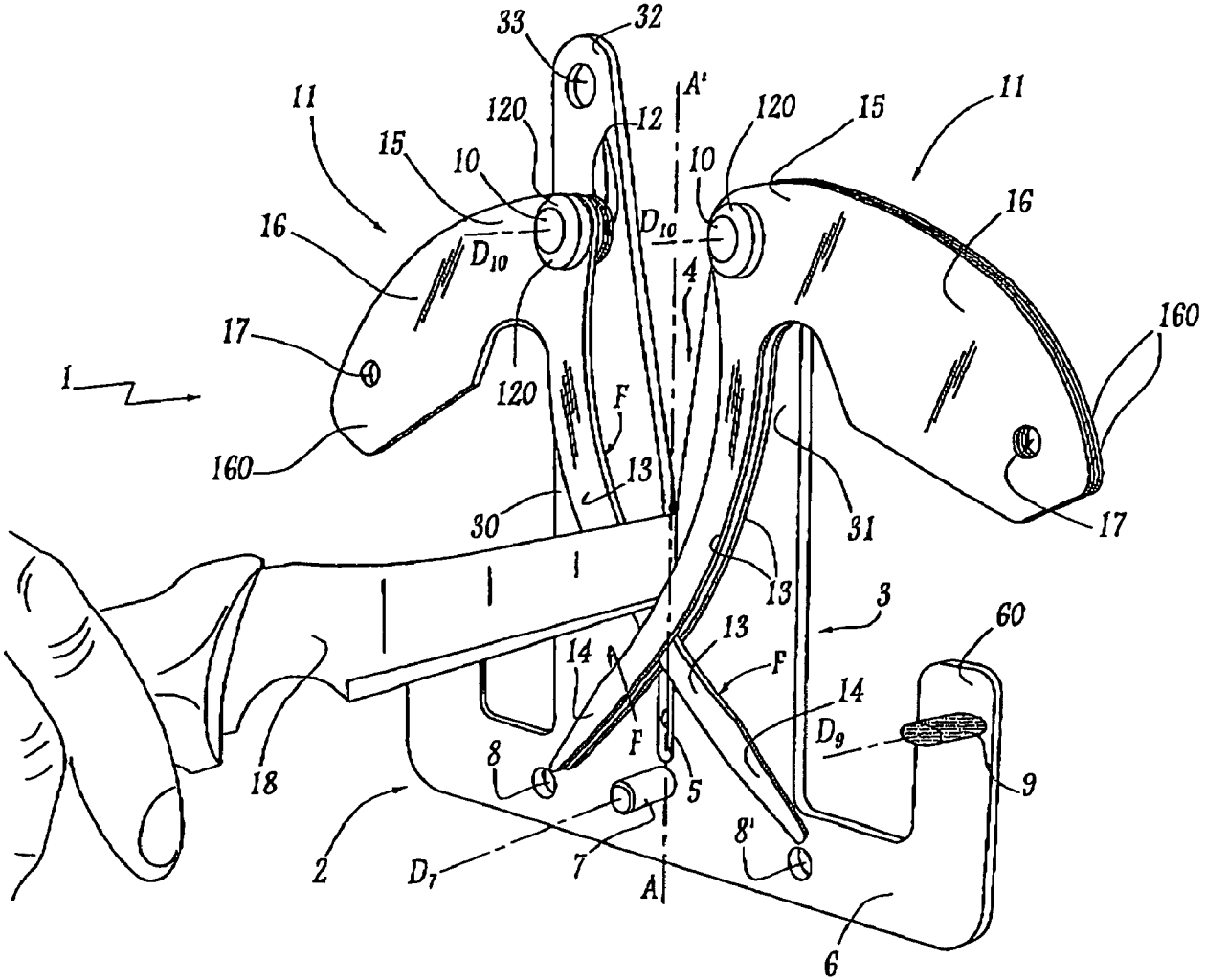

In an intermediate position, illustrated in FIG. 3, the inwardly curved arms 13 move away from the edges of the cut-out 4 and no longer cover the edges. The rectilinear ends 14 of the arms intersect in the region of the intersection between the cut-out 4 and the aperture 5. When the levers 11 are in this intermediate position, the ends 14 thereof are no longer in abutment against the stops 9 or 7, in the same manner as the counterweights 16 are not in abutment against the stops 9.

The edge F of each arm 13, that is orientated in the direction of the cut-out 4 or the aperture 5 of the support, is smooth and polished in the inwardly curved portion of the arm 13 and finely ribbed, in the manner of a sharpening steel, in the region of the rectilinear end 14 thereof.

Figure 2:
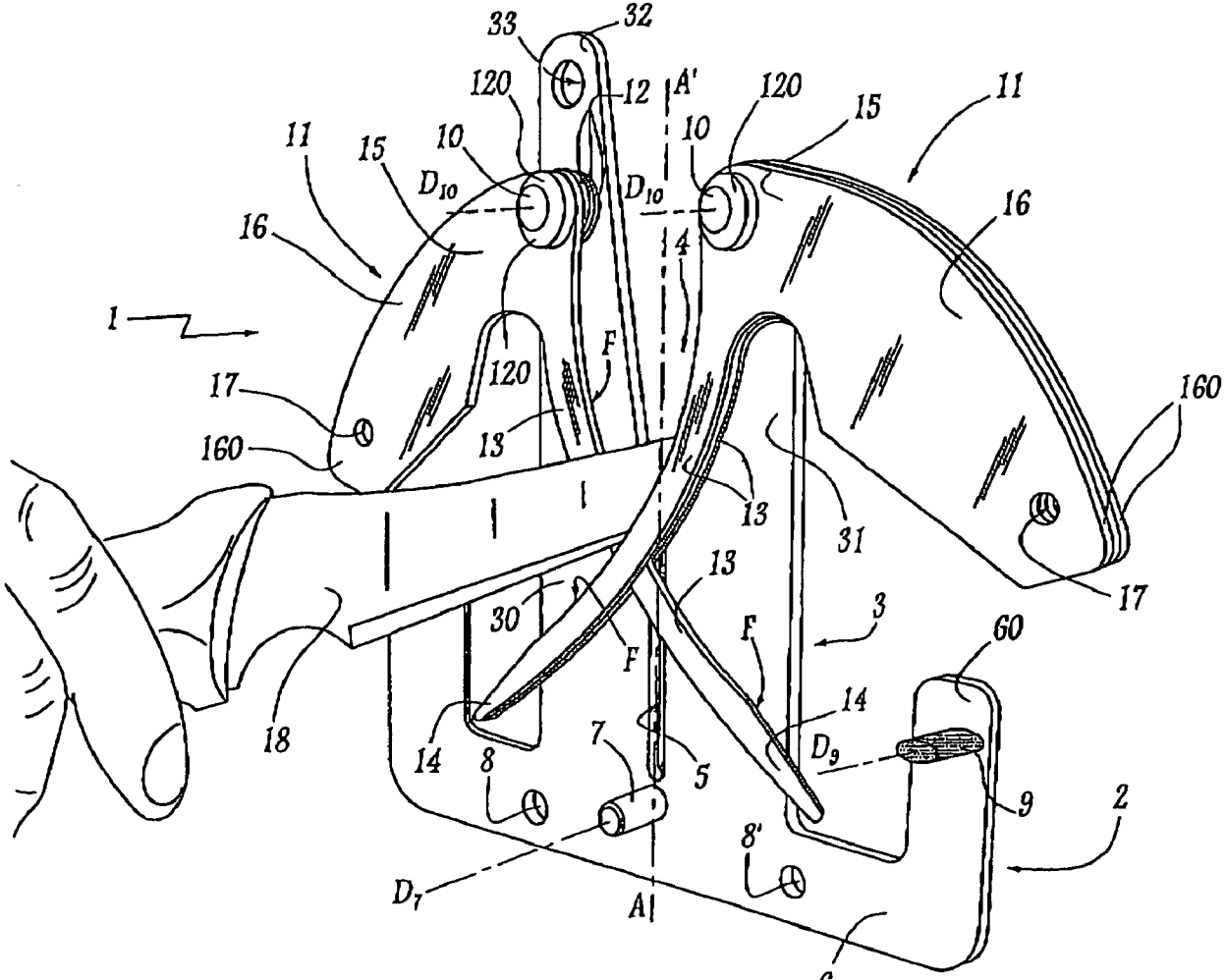
FIGS. 2 to 4 are perspective views of the device illustrated in FIG. 1 in various positions for use, the blade of a knife being illustrated at the beginning of the sharpening operation, during the sharpening operation and at the end of the sharpening operation, respectively.

When it is desirable to rework the edge of a blade 18 of a knife, the blade is positioned in the cut-out 4 until the edge of the blade is in abutment against the three levers 11 in the region of their intersection, as shown in FIG. 2. The positioning and the guiding of the blade 18 are facilitated by the fact that the arms 13 partially conceal the periphery of the cut-out 4, which prevents the blade 18 from "engaging" on one of the walls of the cut-out 4 and thus becoming increasingly blunt. It is also possible to provide the free ends of the portions 31, 32 of the support with a protection, for example, a coating of polymer, in order to increase the conservation of the blade 18 and/or the support 2 when the blade is positioned. The guiding of the blade 18 is also facilitated by the rounded shape of the edge F of the arms 13.

In this position, if the blade 18 is pressed whilst carrying out a backward translation movement, the blade 18 is forced to insert itself into the aperture 5 extending the cut-out 4 as far as a final position in which the blade 18 is in the region of the closed end of the aperture 5, as illustrated in FIG. 4. Over this path, the blade rubs against the polished portion of the edge F of the arms 13 and is thus sharpened. When it moves over the end 14 of each arm 13 which is finely ribbed, the slight defects in the blade, brought about by impacts on the cutting edge of the blade, are corrected. In this instance, when the blade 18 has slight defects, the blade is first moved between the ribbed ends 14 before reshaping the edge of the blade 18 by means of friction on the polished portion of the edge F. If necessary, the sharpening of the blade is thus complemented by a preliminary grinding operation.

Over this path, the blade 18 is held and guided between the levers 11. The cutting edge of the blade 18 thus abuts against three contact points which are formed by the intersection zone of the levers and in particular by their arms 13.

The force applied to the blade by each lever is identical and progressive over the path of the blade. The closer the end 14 of the arms 13 becomes, the greater the force must be to retain the blade 18 in contact with the levers 11 in order to balance the return force applied by the counterweights 16. This force increases when the blade 18 is moved towards the end of the aperture 5 by means of a lever effect: the distance between the abutment points of the blade on the levers 11 and the rotation shafts 10 thereof increasing.

This increase in the force applied to the blade by each lever allows the sharpening to be adapted in accordance with the zone of the blade in which it is applied. The blade is generally more worn in the first third of the length thereof from the point of the blade. This portion of the blade 18 is positioned in the sharpening zone formed by the ends 14 so that the sharpening of this portion of the blade is optimal.

Owing to the presence of three permanent abutment points for the cutting edge of the blade 18 on the levers 11, homogeneous and effective sharpening of the blade 18 is achieved.

When the blade 18 is withdrawn from the cut-out 4, the levers 11 return to their initial position under the action of their counterweights 16. Their path is stopped by the stops 9. As the stops are produced from elastomer or another attenuating material, this allows the noise produced by the "impact" of the ends 160 of the counterweights 16 on the stops 9 to be attenuated or even eliminated. The shape of the stops 9 also contributes to the attenuation of the impact, by preventing the rebound of the ends 160 of the counterweights 16 on the stops 9. In this manner, a sharpening device is produced whose operation is silent, which is particularly advantageous taking into account the generally noisy environment which is encountered in the food-processing industry and the frequency with which the sharpening devices are used.

Figure 5:
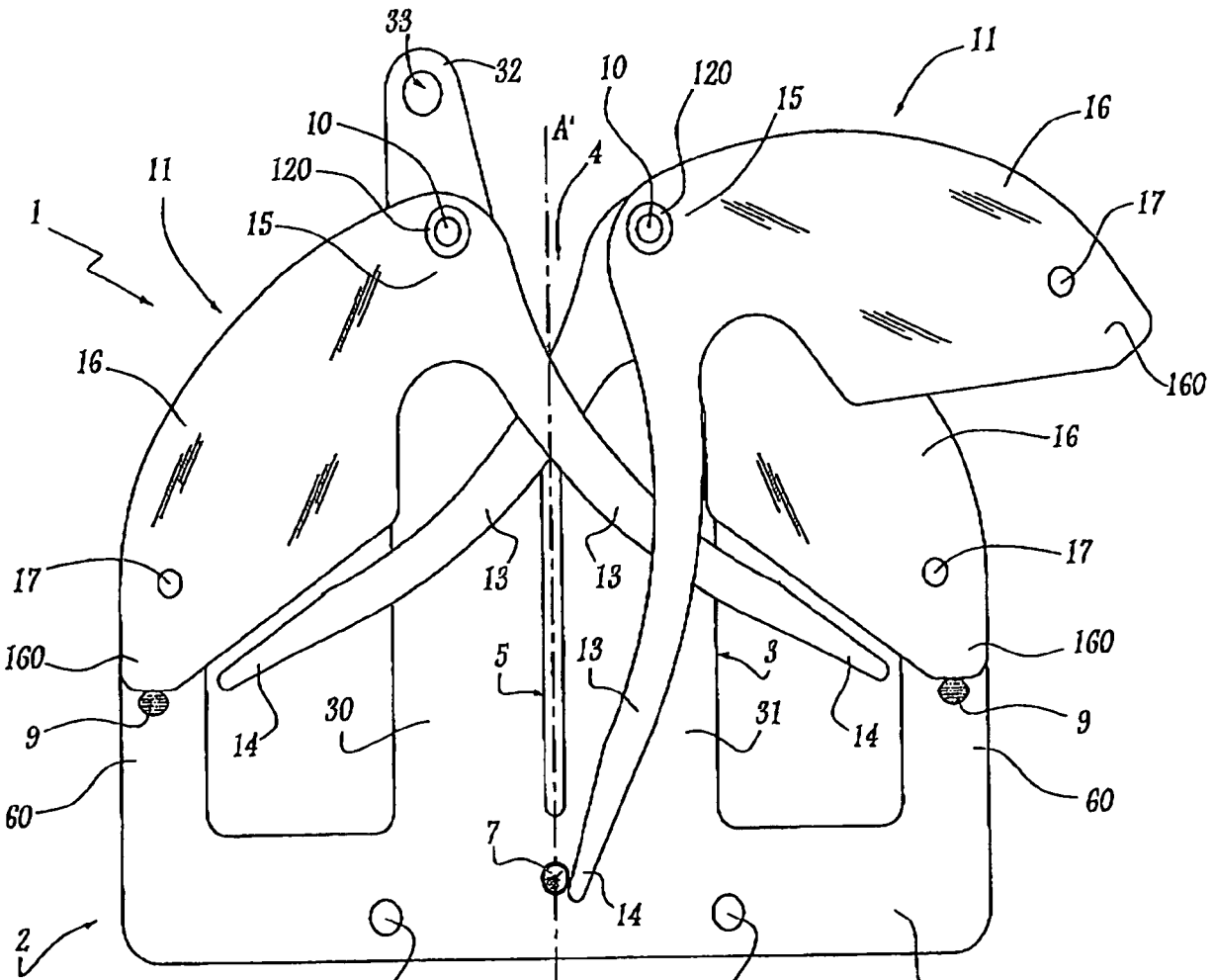
FIG. 5 is a front view of the device illustrated in FIG. 1, in a configuration in which the levers are retained in a position which allows them to be cleaned.

The length of the central stop 7 is suitable for being able to pass a lever 11 with force from the other side of the stop 7, relative to its rest position. This is facilitated, for example, by a play which is provided between the discs 12 and the levers 11. In this manner, as illustrated in FIG. 5, a lever 11 is retained in a position in which it has maximum spacing from the leg 3. In this position, referred to as the cleaning position, the levers 11 and in particular the counterweights 16 are readily accessible which allows them to be cleaned, for example, with a high-pressure jet.

In an embodiment which is not illustrated, the stop is surrounded by a sleeve of protective material, for example, of elastomer, rubber or polymer. This material, which is preferably flexible, allows the degradation of the portions of the levers 11 to be prevented, in particular the ends 14 in contact with this stop 7. Furthermore, the thickness and the flexibility of the material can be selected so as to produce a stop point which is variable in accordance with the force applied by the portions of the levers 11 which come into contact with the stop 7.

When the stop 7 is provided with its flexible protective sleeve, an additional force is required on the blade in order to move the ends 14 of the arms 13 into "final" stop. This force promotes the cutting of the blade, the blade being able to be more readily sharpened as it passes over the polished edge F.

Figure 6:
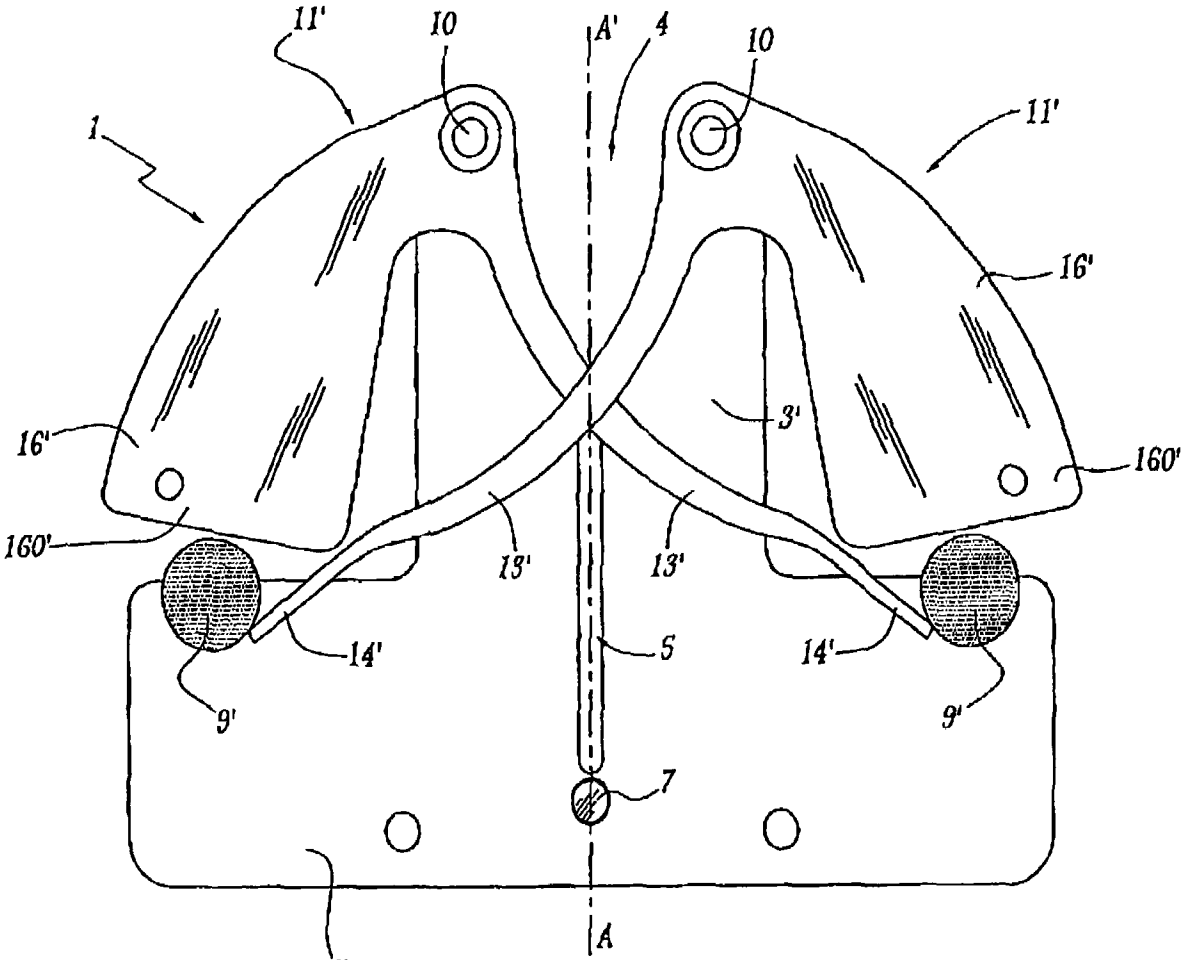
FIG. 6 is a front view of a sharpening device according to a second embodiment.

FIG. 6 illustrates a second embodiment of the device. In this instance, the levers 11' are illustrated in the rest position. The arms 13' are longer than the arms 13 and the ends 14' are sufficiently large to come into abutment against the stops 9'. These have an identical shape to the stops 9 or, as illustrated in FIG. 6, a cylindrical shape. In this embodiment, the counterweights 16' have a suitable shape so that the ends 160' thereof are not in contact with the stops 9'.

In this variant, the support 2 is illustrated with the transverse bar 6' having a shape which is different from that of the bar 6, in the same manner as the leg 3' does not have a gripping element 32.

It is possible to provide, in a configuration which is not illustrated, levers 11' as described above, mounted on a support 2 which is identical to that described in the first embodiment.

In another configuration, the shape and the curvature of the arms 13; 13' are different from those described. In this instance, the shape and the dimensions of the cut-out 4 and the aperture 5 are adapted to those of the arms.

In another embodiment, the arm 13; 13' of at least one lever 11; 11' has an edge F which is ribbed along the entire length of the arm and not only at the end 14; 14'.

In another configuration, the arm 13; 13' of at least one lever 11; 11' has an edge F which is polished over the entire length of the arm, including the end 14; 14'.

In the same manner, in a variant, it is possible to provide four or five levers which intersect in a staggered manner in order to increase the number of contact points between the blade and the levers in the sharpening zone of the blade.

In a variant, a support 2 can be equipped with levers 11; 11' on the two faces thereof. All the levers 11; 11' fixed to the same face of the support 2 have, for example, their edge F polished or ribbed over the entire length of the arms 13; 13' and all the levers 11; 11' fixed to the other face of the support 2 have their edge F polished or ribbed over the entire length of the arms 13; 13', respectively. A device of this type allows the filing and sharpening of the blades to be carried out in an independent manner. It is also possible to fix, to each face of the support 2, levers 11; 11' as described above, that is to say, with an edge F polished in the curved portion of the arm 13; 13' and ribbed at the end 14; 14'. A device of this type can, for example, be used alternately by two users at adjacent workstations.

In a variant, the shape of the arm which forms the counterweight 16 can be different from those illustrated, for example, parallelepipedal. In the same manner, the number and the arrangement of the holes 17 or other means for fastening supplementary counterweights, for example, hooks, can be envisaged. Materials other than stainless steel can be envisaged, in particular for the support. This can be a polymer suitable for foodstuffs.

In another configuration, the stops 7, 9; 9' may have different shapes and dimensions to those described, for example, they may be parallelepipedal or triangular.

It is also possible to envisage stops and/or arms and/or a support which are provided with a means of identification, for example, coloured stops or markings on the support.

The invention claimed is:

1. A device for sharpening a blade of a manual cutting tool, the device comprising; a support which is provided with a generally vertical cut-out, a pair of first sharpening elements pivotally mounted in spaced relationship about a first pivot point to the support on one side of the cut-out with each of the first sharpening elements being independently pivotal about the first pivot point, a second sharpening element being pivotally mounted at a second pivot point to the support on an opposite side of the cut-out, each of the first and second sharpening elements being formed as generally identical levers, each lever being angled and provided with a first cutting tool engaging sharpening arm that extends generally downwardly from one side of one of the respective first and second pivot points across the cut-out and which has an upper generally concavely curved surface portion and an end having a substantially rectilinear edge and a second arm that forms a counterweight for the lever and constitutes a means for returning the lever into an initial rest position by means of gravity, the second arm of each lever being angled outwardly relative to the first arm thereof on an opposite side of the respective first and second pivot points, the second sharpening element being mounted in an opposite orientation to the pair of first sharpening elements so that the first arm thereof is movable between the first arms of the first sharpening elements and each of the levers being pivotal about a geometric axis ($D_{10}$) which is generally perpendicular relative to a longitudinal vertical direction (A-A') of the cut-out.

2. The device of claim 1, wherein the first arm of each lever includes one edge (F) which has a generally semi-circular cross-section and is adapted for being in contact with a blade of a cutting tool.

3. The device of claim 2, wherein the edge (F) of the first arm of at least one lever is polished at least in the concavely curved portion of the first arm and is finely ribbed in a manner of a sharpening steel, at least in a region of the end of the same first arm.

4. The device of claim 1, wherein the levers are blocked in the rest position, in which a spacing between the ends of the first arms of the two levers of the first sharpening elements and the end of the first arm of the lever of the second sharpening element is at a maximum, by means of two stops which are fixed to the support and which are produced from a material which attenuates impacts and which two stops are engaged by ends of the second arms of the levers when the levers are in the rest position.

5. The device of claim 4, wherein the support is provided with a third stop which is generally located between the two stops and which blocks the levers in a position in which the spacing between the ends of the first arms of the first sharpening elements is at a minimum relative to the end of the first arm of the second sharpening element.

6. The device of claim 5, wherein the third stop has a length and a shape suitable for retaining at least one of the levers in a cleaning position in which it is not free to pivot.

7. The device of claim 5, wherein the third stop is provided with a protection sleeve of flexible material.

8. The device of claim 1, wherein the levers are arranged so as to cover periphery of the cut-out in the support when the levers are in the rest position.

9. The device of claim 1, wherein each second arm includes means for fixing a supplementary gravity return means thereto.

10. The device of claim 1, wherein the levers are spaced from the support and each other by removable discs.

11. The device of claim 1, wherein the support is provided with a gripping means that extends outwardly from a main body of the support.

* * * * *